US005363981A

United States Patent [19]

Giblin et al.

[11] Patent Number: 5,363,981

[45] Date of Patent: Nov. 15, 1994

[54] BRIDGED INTEGRAL LINER

[75] Inventors: Edward Giblin, Finksburg; Kymberly Moran, Baltimore; Jeannine Griffiths, Reisterstown, all of Md.

[73] Assignee: Lever Brothers Company, Division of Conopco, Inc., New York, N.Y.

[21] Appl. No.: 998,305

[22] Filed: Dec. 30, 1992

[51] Int. Cl.[5] ..... B65D 5/50; B65D 5/56

[52] U.S. Cl. ..... 220/416; 220/418; 229/933; 493/62; 493/74; 493/906

[58] Field of Search ..... 220/416, 418, 441, 443; 229/146, DIG. 9; 493/62, 74, 906–908

[56] References Cited

U.S. PATENT DOCUMENTS

| | | | |
|---|---|---|---|
| 1,580,366 | 4/1926 | Bergstein | 229/DIG. 9 |
| 2,367,476 | 1/1945 | Tyrseck . | |
| 2,396,150 | 3/1946 | Bonville . | |
| 2,473,055 | 6/1949 | Guyer . | |
| 2,672,273 | 3/1954 | Smith | 229/225 |
| 2,701,088 | 2/1955 | Tyrseck | 229/DIG. 9 |
| 2,702,663 | 2/1955 | Klein . | |
| 2,758,446 | 8/1956 | Imbs . | |
| 2,762,550 | 9/1956 | Goettsch et al. . | |
| 2,783,692 | 3/1957 | Bolding | 493/906 |
| 2,783,929 | 3/1957 | Delaney | 220/416 |
| 2,803,394 | 8/1957 | Ringler . | |
| 2,822,118 | 2/1958 | Will . | |
| 2,824,684 | 2/1958 | Ahlers | 229/DIG. 9 |
| 2,836,343 | 5/1958 | Will | 229/146 |
| 2,874,524 | 2/1959 | Ringler . | |
| 2,922,564 | 1/1960 | Van Rosen . | |
| 2,950,043 | 8/1960 | Ringler . | |
| 3,039,671 | 6/1962 | Chiamardas . | |
| 3,347,446 | 10/1967 | Guyer et al. . | |
| 3,356,281 | 12/1967 | Buttery | 229/DIG. 9 |
| 3,708,108 | 1/1973 | Rosenburg, Jr. | 229/146 |
| 4,196,842 | 4/1980 | Focke et al. | 220/416 |
| 4,388,999 | 6/1983 | Berry et al. | 220/416 |
| 4,498,582 | 2/1985 | Tomassi et al. | 229/DIG. 9 |
| 4,726,471 | 2/1988 | Whately et al. | 220/416 |
| 4,815,592 | 3/1989 | Kunkel . | |
| 5,058,748 | 10/1991 | Giblin et al. | 220/416 |
| 5,137,148 | 8/1992 | Evers . | |

FOREIGN PATENT DOCUMENTS

| | | | |
|---|---|---|---|
| 2135776 | 2/1973 | Germany . | |
| 9002373 | 5/1990 | Germany . | |
| 1023071 | 3/1966 | United Kingdom . | |
| 1456419 | 11/1976 | United Kingdom | 220/416 |
| PCT/GB93/-02672 | 12/1993 | WIPO . | |

*Primary Examiner*—Gary E. Elkins

*Attorney, Agent, or Firm*—Gerard J. McGowan, Jr.

[57] ABSTRACT

A carton blank having an integral liner, an erected carton made from the blank and a process for making the carton blank. The integral liner includes portions excised therefrom to reduce paperboard resource and refuse. The blanks are preferably made by cutting two reverse-oriented blanks and mating liners from a single web of paperboard.

23 Claims, 5 Drawing Sheets

BRIDGED INTEGRAL LINER

BACKGROUND OF THE INVENTION

Cartons for super concentrated detergent products are disclosed in patents such as Giblin et al U.S. Pat. No. 5,058,748 and Gunn et al U.S. Pat. No. 4,986,420. Such cartons include outer panels and an inner liner. The Giblin et al patent discloses that the liner may be integral with the rest of the carton. Various cartons with liners, some of which are integral, are disclosed in Goodyear U.S. Pat. No. 2,348,277, Guyer U.S. Pat. No. 3,347,446, Imbs U.S. Pat. No. 2,758,780, Smith U.S. Pat. No. 2,672,273 Tyrseck U.S. Pat. No. 2,367,476 and Rosenburg U.S. Pat. No. 3,708,108.

Liners are useful for providing barrier properties and for improving the structural intregity of the cartons. Moreover, the liners provide a base with which the lid can be reclosed and help to minimize escape of perfume and ingress of moisture and other outside influences.

Despite the above advantages, liners have the disadvantage of utilizing additional resource and in creating additional material to be discarded after use.

It is known to provide a separate, four-sided liner having portions of the material excised to conserve paperboard material.

SUMMARY OF THE INVENTION

The invention is directed to a carton blank, especially suitable for containing super concentrated powdered detergent, which includes an integral liner which is bridged. The liner is preferably at least three-sided. It has been discovered that, when the liner is shaped appropriately, it is possible to minimize the amount of paperboard to be used and ultimately to be discarded by virtue not only of the excised portion, but also by cutting two oppositely oriented liners from a single web.

The amount of material eliminated from the liner may vary from small amounts to large amounts. Preferably the excised portion of the liner is from a middle wall of a three wall liner. When the two liners are cut from the same web, preferably the liners are complementary when oriented in opposite directions. The invention is also directed to a process for making carton blanks having integral liners wherein the carton blanks are cut from the same web. The invention is also directed to erected cartons having integral carton blanks.

DETAILED DESCRIPTION OF THE INVENTION

Figure 1:
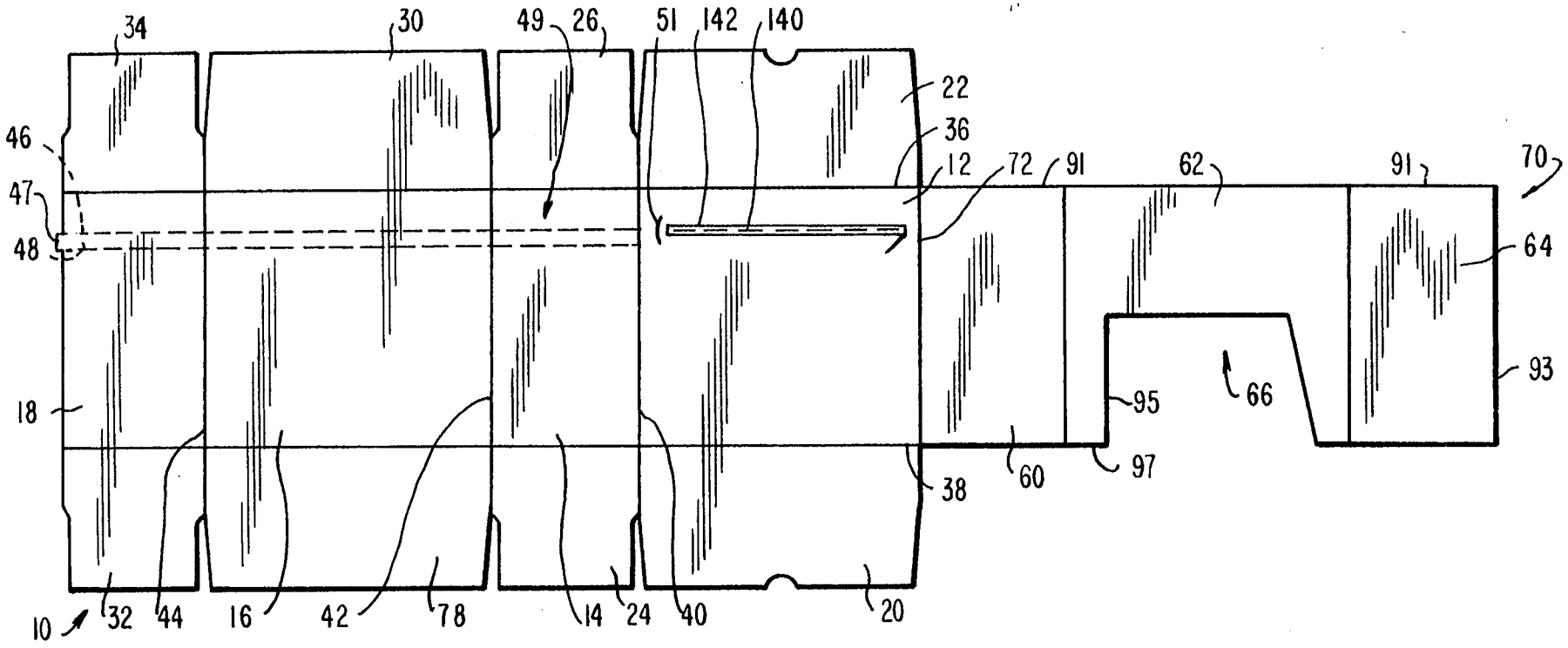
FIG. 1 is a plan view of a paperboard blank according to invention.

Paperboard carton blank 10 comprises front panel 16, first and second side panels 18 and 14, respectively and rear panel 12. Panels 18, 16, 14 and 12 are separated from each other by score lines 44, 42 and 40 respectively. Upper and lower minor flaps 26, 24, 34 and 32 extend respectively from side panels 14 and 18. Extending from the top and bottom of front panel 16 are upper and lower outside major flaps 30 and 28, respectively. Similarly upper and lower inside major flaps 22 and 20 extend respectively from the top and bottom of rear panel 12.

A tear tape 49 formed by upper line 46 and lower line 48 is present in panels 18, 16 and 14. The lines are generally parallel lines of perforation in the paperboard. Finger tab 47 is provided for grasping by the consumer. Preferably, the finger tab extends beyond the edge of the carton for easier access. Instead of perforation, other separation means such as cut scores may be employed. Such cut scores would extend partially through the paperboard. The tear tape terminates functionally on rear panel 12 by virtue of cut 51, although the tape may include a filament which extends in a straight line along the tear tape and through the rear panel and through all the walls of the liner, as well.

Integral with the carton 10 is liner 70. Liner 70 comprises a first side wall 60, a front wall 62 and a second side wall 64. First side wail 60 is separated from rear panel 12 by score line 72. To ease folding of the liner prior to erection of the carton, score 72 and the other vertical scores of the liner and of the carton may be provided with segmented cuts, e.g., 100% through the paperboard, at intervals along the score line. This facilitates flattening of the carton, particularly after it has been glued into a flattened tube. In addition to the segmented cuts, the score lines may be partially cut, e.g., 50%, through the paperboard. Front liner wall 62, while generally of rectangular shape has a portion 66 excised therefrom. The remaining portion is adequate to serve the liner functions of providing structual integrity and providing a surface at which the top of the carton can close, but at the same time eliminates unecessary paperboard. This conserves paperboard resource and also results in less paperboard or disposal once the carton has been used.

Figure 2:
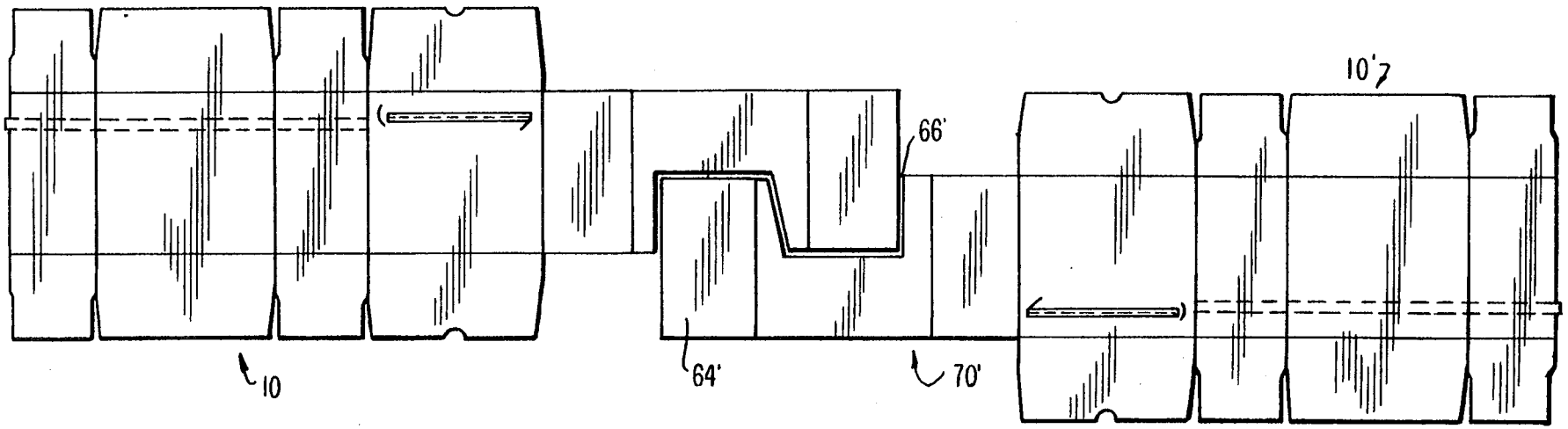
FIG. 2 is a plan view of paperboard blanks mating in reverse orientation according to the invention.

Carton blank 10 is preferably formed from the same single web of paperboard as is used in the formation of liner 70' shown in FIG. 2. The web may be cut with either a single or a double blade. Formation of the two blanks from a single web results in less loss of paperboard resource. In accordance with the process of the invention, the two carton blanks formed from the web may, but need not, have bridged liners, i.e. the integral liners need not include excisions. FIG. 2 shows blanks 10 and 10' after they have been cut from the same paperboard. As can be seen in the figure, the liners are complementary and "mate" together. That is, the portion 66 excised from blank 10 is used to form a part of wall 64' and other aspects of the liner distal to the excision 66'. This results in a savings on paperboard resource.

Any shape may be used for the excised portion of the integral liner. However, it is preferred that the excision occur in the course of forming two blanks from a single web so that the two blanks have liners wherein second side panel 64 can be comfortably accommodated within the excised portion of middle panel 62. The preferred integral liner includes at least two walls which are preferably just slightly less in height than the corresponding carton panels and one wall intermediate the two walls, which includes an excised portion which reduces at least a portion of its vertical dimension (vertical in the orientation in which the carton is to stand). The intermediate wall, therefore forms a bridge between the two normal height walls. It will be appreciated that although it is preferred that the height of a portion of the liner be approximately the same as that of the carton panels, it will be slightly less so as to permit the liner to be accommodated comfortably within the carton. Similarly, the other dimensions of the liner walls should be slightly less than those of the carton panels.

The top edge 91 of the liner is preferably substantially straight, parallel to and just slightly below scoreline 36 separating the carton panels from the top flaps. This helps assure that the top of the liner can function to close the carton securely after it has been opened. Preferably, the distal edge 93 of the liner is straight and parallel to score lines 44, 42 and 40 to assist in fabrication and to ensure adequate strength. Preferably edge 95 of the excision is also relatively straight, i.e., generally parallel to score lines 44, etc. Ideally, edge 95 forms an angle of from 90° to 80° with the bottom edge 97 of the liner. Bottom edge 97 is desirably slightly above and generally parallel to scoreline 38, except for the excision.

Preferably, the normal height walls of the liner supporting the bridge are at least 80% of the height of the corresponding carton panel, especially at least 90% and most preferably at least 95% of the height of the corresponding carton panel. Preferably, a portion of the bridge is no greater than 75% of the height of the corresponding carton panel, especially no greater than 60% of the height of the corresponding carton panel and particularly no greater than 50% of the height of the corresponding carton panel.

Figure 3:
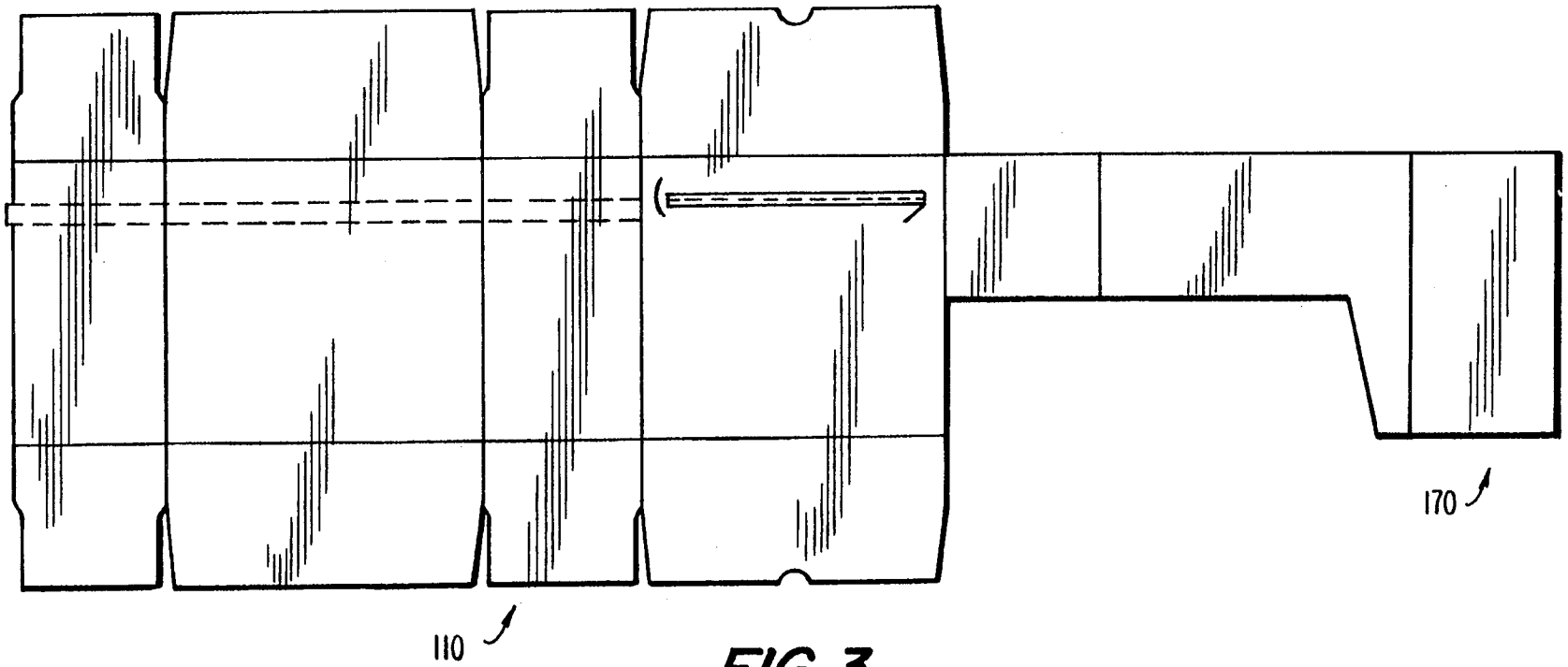
FIG. 3 is a plan view of a paperboard blank in which the excision from the integral liner is larger.
Figure 5:
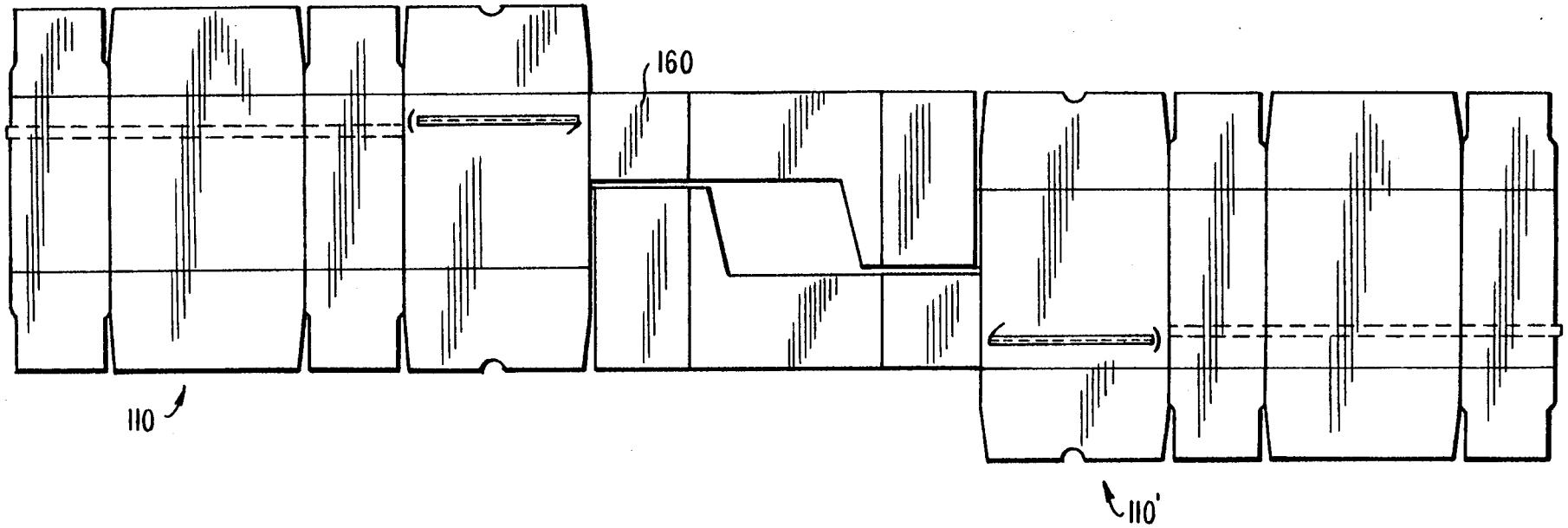
FIG. 5 is a plan view of paperboard blanks having large excisions mating in reverse orientation, according to the invention.

The excision from the integral liner can be accommodated within one wall of the liner, as in liner 70 of FIG. 1. Alternatively, the excision may be large enough to encompass more than one wall of the liner such as 1, 2, or even 3 walls of the liner, as seen in liner 170 of carton 110 in FIG. 3. Here, the excision is accommodated within the first side wall and the front wall of the liner. It will be apparent that a trade off of structural integrity for paperboard resource occurs when the size of the excision is increased. In FIG. 5 two blanks 110 and 110' having large excisions are shown in reverse "mating" position.

Considering, e.g., FIGS. 2 and 5, It will be appreciated that the excision decreases the combined width of the mating cartons. In FIG. 5, if the excisions were not present, the edges of the upper flaps of cartons 110' and 110 would be further separated so that the mating cartons would occupy even more space on the web. It is expected that a 4⅝ inch long and 4⅜ inch wide paperboard web from which could be cut 7 cartons with integral liners would accommodate 8 such cartons where an excision of approximately 50% of the height of the liner is made.

The carton is erected by adhering the outside surface of second liner wall 64 to the inside surface of panel 14 and the outside surface of wall 60 to the inside surface of panel 18. Subsequently, the blank is squared, and the minor flaps and subsequently the inside and outside major flaps respectively are folded inwardly and adhered to each other to construct the carton.

Figure 4:
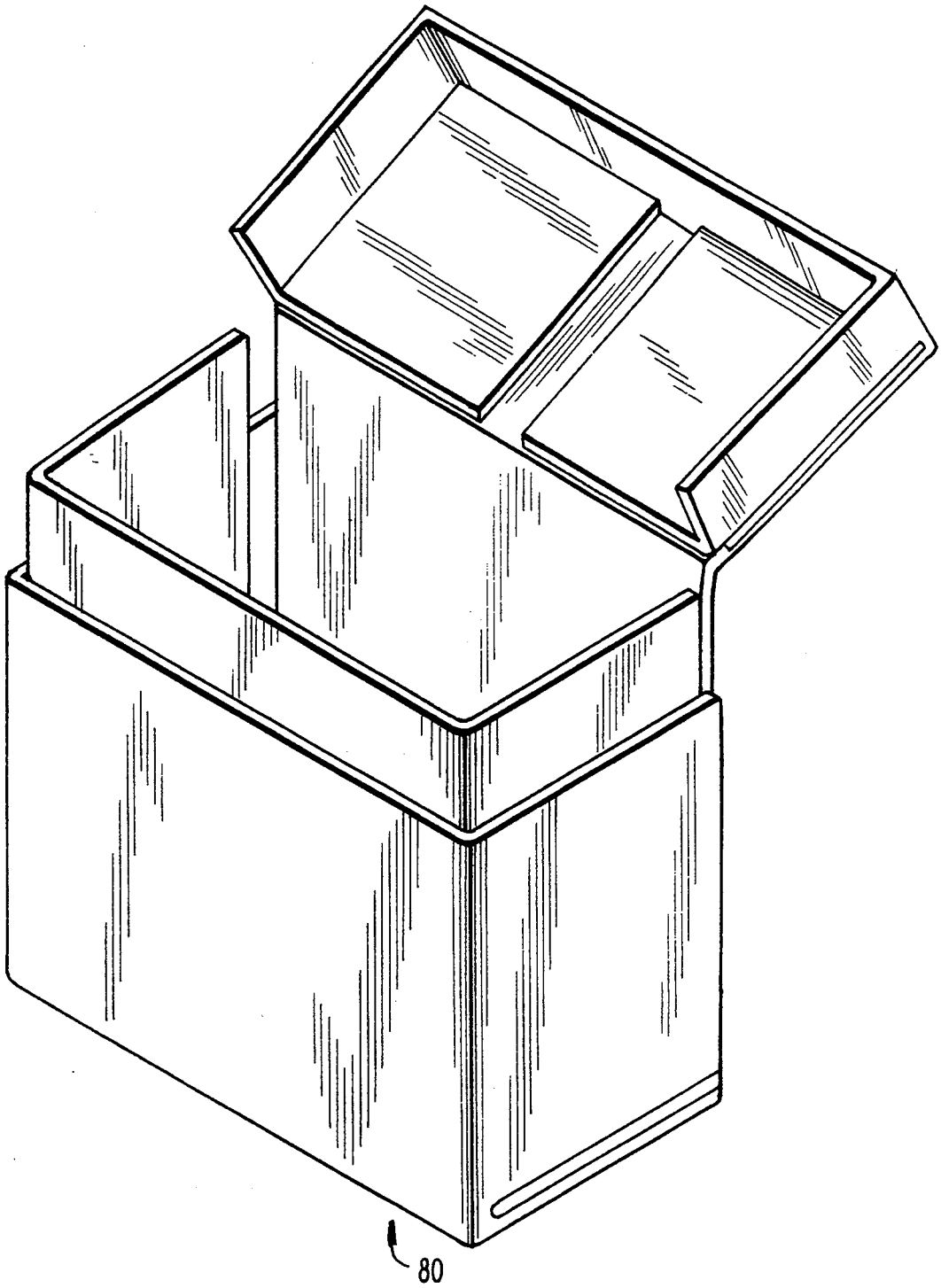
FIG. 4 is an erected carton made from the blank of FIG. 1.

Pulling on the tear tape separates the portion of the carton above the tear tape from that below the tear tape, thereby opening the carton as seen in FIG. 4. If desired, a small plastic filament or other cord may be adhered to the inside of the tear tape intermediate the cut or perforated lines to enhance tearability. The filament may be impregnated with hot melt for heat sealing.

The tear tape preferably extends functionally across substantial portions of only 3 panels of the cartons, although the filament may extend in a line along the entire length of the carton blank including the liner walls. Since the tear tape does not extend across substantial portions of the rear panel, the upper portion of the erected carton, which serves as a cover, remains associated with the lower portions at the rear panel, which serves as a hinge. Thus, once the tear tape is pulled thereby separating upper and lower aspects of the carton on three sides, the upper aspect can be left in the closed position or can be lifted into the open position remaining associated with the lower aspect only at the rear panel. In this position, the consumer has access to the product and may lower the upper aspect of the carton back into closed position when desired.

The role of the rear panel as a hinge is facilitated by the addition of hinge means thereto. As seen in FIG. 1 rear panel 12 include two hinge means, perforations 140 and score line 142, both of which extend along the same line as the uppermost of the tear tape cut score or cut perforations. The illustrated hinge means acts as a dead fold hinge in that it keeps the open cover in the open position until the consumer closes the cover.

It will be apparent that the invention may likewise be applied to integral four-sided liners. The liner may be made of a barrier or a non-barrier material, as desired.

The carton of the invention may be made of any of the material typically used for carton manufacture, such as paperboard or plastic. The carton blank may be made of or adhered to a barrier material. Barrier materials are used particularly to inhibit the entry of moisture and oxygen into the carton and to minimize the escape of perfume and any other volatile ingredients from the product within the carton.

The carton blanks may comprise outside-or-inside film laminated paperboard. The paperboard may be laminated with, e.g. film or two-sided acrylic coated oriented polypropylene, e.g. "420HS" available from the Mobil Oil Corporation. Or, the carton blank may comprise barrier boards such as a PVDC (polyvinylidene chloride) treated board. A barrier may also be created by a printed coating or via a polyethylene or other extrusion coating, for example an inside polyethylene coating.

By barrier is meant a water vapor transmission rate greater than 0.5 grams of water per 100 square inches per 24 hours at 80° F./80% RH, typically from 0.5 to 0.9, especially 0.7 for inside film laminated paperboard.

It will be appreciated that many features of the cartons and carton blanks described in Giblin et al. U.S. Pat. No. 5,058,748 will be applicable to the cartons and carton blanks of the instant invention. Therefore, the disclosure of the Giblin et al patent is incorporated by reference herein.

The use of an integral liner eliminates the need for expensive equipment for inserting the liner into the carton. The liner may be adhesively attached to the carton on any combination of panels. If a riveted handle of the type shown in the Giblin et al patent mentioned above is used, the rivets would go through the first and second side walls of the integral liner and through the corresponding side panels of the carton.

The integral liner provides structural support and top load strength for the carton. The integral liner also provides rigidity and buldge resistance for super concentrated powders, that is high density products. The use of the integral liner results in improved dimensional sizing and fit since the liner is diecut at the same time and together with the carton.

What is claimed is:

1. An erected carton comprising a first side panel, a front panel adjacent thereto, a second side panel adjacent to the front panel and opposite the first side panel, a rear panel between said first and second side panels, bottom closure flaps, top closure flaps, a tear tape suitable for separating portions of the panels from each other and extending from at least said first side panel through said front panel to said second side panel, said tear tape not functionally traversing all of the rear panel, whereby said rear panel acts as a hinge when said tear tape is removed from said first and second side panels and said front panel, an integral liner including at least three walls, one of which is separated from one of said panels by a score line, at least one of said integral liner walls being in the shape of a rectangle or square having material excised therefrom to form an area of excision at a bottom edge thereof, a portion of the liner distal to said area of excision being at least 80% of the height of one of said carton panels.

2. The carton according to claim 1 wherein said liner includes exactly three walls.

3. The carton according to claim 1 wherein said liner walls comprise two rectangular side walls and a front wall intermediate said side walls.

4. The carton according to claim 3 wherein said front wall has said material excised.

5. The carton according to claim 3 wherein said excised material is taken from said front wall and said side wall which is separated from one of said carton panels by a score line.

6. The carton of claim 1 wherein the score line separating said liner from said panels further comprises segmented cut lines.

7. The carton of claim 1 wherein a portion of said liner has a height of no greater than 60% of the front, rear and first and second side panels.

8. A carton blank comprising a first side panel, a front panel adjacent thereto, a second side panel adjacent to the front panel and opposite the first side panel, a rear panel between said first and second side panels, bottom closure flaps, top closure flaps, a tear tape suitable for separating portions of the panels from each other and functionally extending from at least said first side panel through said front panel to said second side panel, said tear tape not functionally traversing all of the rear panel, whereby said rear panel acts as a hinge when said tear tape is removed from said first and second side panels and said front panel, an integral liner including at least three walls, one of which is separated from one of said panels by a score line, at least one of integral liner walls being in the shape of a rectangle or square having material excised therefrom at a bottom edge thereof to form an area of excision, a portion of the liner distal to said area of excision being at least 80% of the height of one of said carton panels.

9. The carton blank according to claim 8 wherein said liner includes exactly three walls.

10. The carton blank according to claim 8 wherein said liner walls comprise two rectangular side walls and a front wall intermediate said side walls.

11. The carton blank according to claim 10 wherein said front wall has said material excised therefrom.

12. The carton blank according to claim 10 wherein one of said side walls is proximal to said carton and the other is distal to said carton and said excised material is taken from said front wall and said proximal side wall.

13. The carton blank of claim 8 wherein a portion of said liner has a height of no greater than 60% of the front, rear and first and second side panels.

14. An erected carton comprising a first side panel, a front panel adjacent thereto, a second side panel adjacent to the front panel and opposite the first side panel, a rear panel between said first and second side panels, bottom closure flaps, top closure flaps, a tear tape suitable for separating portions of the panels from each other and extending from at least said first side panel through said front panel to said second side panel, said tear tape not functionally traversing all of the rear panel, whereby said rear panel acts as a hinge when said tear tape is removed from said first and second side panels and said front panel, an integral liner including at least three walls, one of which is separated from one of said panels by a score line, said liner terminating in a free edge of one of said integral liner walls which liner free edge is generally parallel to said score line separating said one of said integral liner walls from said one of said panels, at least one of said integral liner walls having material excised therefrom at a bottom edge thereof creating an area of excision, said area of excision comprising a side proximal said separating score line and a side distal said separating score line, said area of excision comprising a free edge generally parallel to said terminating free edge on the side proximal to said separating score line, a portion of said liner having a height of no greater than 60% of the front, rear and first and second side panels, a portion of said liner distal to said area of excision being at least 80% of the height of one of said carton panels.

15. The carton of claim 14 wherein the score line separating said liner from said panels further comprises segmented cut lines.

16. The carton of claim 14 wherein said liner includes a top edge which is generally perpendicular to said separating score line.

17. A carton blank comprising a first side panel, a front panel adjacent thereto, a second side panel adjacent to the front panel and opposite the first side panel, a rear panel between said first and second side panels, bottom closure flaps, top closure flaps, a tear tape suitable for separating portions of the panels from each other and functionally extending from at least said first side panel through said front panel to said second side panel, said tear tape not functionally traversing all of the rear panel, whereby said rear panel acts as a hinge when said tear tape is removed from said first and second side panels and said front panel, an integral liner including at least three walls, one of which is separated from one of said panels by a score line, said liner terminating in a free edge of one of said integral liner walls, which liner free edge is generally parallel to said score line separating said one of said integral liner walls from the one of said panels, at least one of said integral liner walls having material excised therefrom at a bottom edge thereof to form an area of excision, said area of excision having a side proximal said separating score line and a side distal said separating score line said area of excision comprising a free edge generally parallel to said terminating free edge on the side proximal said separating score line a portion of said liner having a height of no greater than 60% of the front, rear and first and second side panels, a portion of said liner distal to said area of excision being at least 80% of the height of one of said carton panels.

18. The carton blank of claim 17 wherein said liner includes a top edge which is generally perpendicular to said separating score line.

19. An erected carton comprising a first side panel, a front panel adjacent thereto and separated therefrom by a first score line, a second side panel adjacent to the front panel and separated therefrom by a second score line and opposite the first side panel, a rear panel between said first and second side panels, said first and second score lines being parallel, bottom closure flaps, top closure flaps, and an integral liner including at least three walls extending from one of said panels and separated therefrom by a score line parallel to said first and second score lines, said liner including an excision forming an area of excision at a bottom edge thereof, a portion of the liner distal to said excision being at least 80% of the height of one of said carton panels.

20. The carton of claim 19 wherein a portion of the liner is substantially the same height as one of said panels.

21. The carton of claim 19 wherein said liner has an end proximal to the separating scoreline and an end distal to said separating score line and the liner is substantially the same height as one of said panels at the end of said liner distal to said separating score line.

22. A process for fabricating a carton blank having front, first side, rear, and second side panels, said front panel being separated from said first and second side panels by parallel score lines, comprising cutting from a single web of paperboard two carton blanks having integral liners in reverse position with respect to each other each of the liners of said two blanks having material excised therefrom at least part of which forms the liner of the other of the two blanks, said liner being separated from one of said front, first side, rear or second side panels by a score line parallel to said parallel score lines.

23. The process of claim 22 wherein said liner comprises at least three walls adapted for lining three panels of said carton blank.

* * * * *